US005975976A

United States Patent [19]

Sekinger et al.

[11] Patent Number: 5,975,976

[45] Date of Patent: Nov. 2, 1999

[54] METHOD OF MAKING STRUCTURED SURFACE WITH PEAK-SHAPED ELEMENTS

[75] Inventors: Kurt Sekinger, Volketswil, Switzerland; Harald Fuchs, Nottuln, Germany; Jean-Francois Paulet, Siblingen; Roman Fuchs, Schaffhausen, both of Switzerland

[73] Assignee: Alusuisse Technology & Management Ltd., Switzerland

[21] Appl. No.: 09/069,058

[22] Filed: Apr. 28, 1998

Related U.S. Application Data

[62] Division of application No. 08/761,848, Dec. 9, 1996, Pat. No. 5,811,917.

[30] Foreign Application Priority Data

Dec. 22, 1995 [CH] Switzerland ..... 03651/95

[51] Int. Cl.[6] ..... H01J 9/02

[52] U.S. Cl. ..... 445/50

[58] Field of Search ..... 445/50, 51

[56] References Cited

U.S. PATENT DOCUMENTS

| | | | |
|---|---|---|---|
| 3,783,325 | 1/1974 | Shelton | 313/336 |
| 4,591,717 | 5/1986 | Scherber | 250/338.1 |
| 5,499,938 | 3/1996 | Nakamoto et al. | 445/50 |

FOREIGN PATENT DOCUMENTS 35110 1/1990 European Pat. Off. .

*Primary Examiner*—Kenneth J. Ramsey
*Attorney, Agent, or Firm*—Bachman & LaPointe, P.C.

[57] ABSTRACT

Structured surface, having a support layer and, connected electrically to it, peak-shaped elements, each peak-shaped element exhibiting a cylindrical or conical shaped stem region adjacent to the support layer and at least two, preferably 2 to 4 peaks at the free end of the stem region. The structured surface is suitable in particular as electron emission source for ultra-flat image screens, for electron lithography or for scanning or transmission microscopy.

6 Claims, 2 Drawing Sheets

METHOD OF MAKING STRUCTURED SURFACE WITH PEAK-SHAPED ELEMENTS

This is a Division of application Ser. No. 08/761,848 filed Dec. 9, 1996 now U.S. Pat. No. 5,811,917.

BACKGROUND OF THE INVENTION

The present invention relates to a structured surface, having a support layer and, connected electrically to it, peak-shaped elements. The invention also relates to the use of this structured surface and a process for its manufacture.

All components in the field of vacuum electronics, such as cathode ray tubes for example, require a cathode to emit electrons into the vacuum. Up to now mainly thermal cathodes have been used for this purpose. These cathodes are heated to temperatures of 1000° C. and more in order that the electrons on the surface of the cathode possess enough thermal energy that they can overcome the potential barrier on the surface of the cathode. The surfaces of thermal cathodes are chosen therefore with suitable surface layers that keep the energy that electrons require to escape as low as possible, this in order that high electron emission can be achieved.

A further possibility for producing electron emitting cathode surfaces is to apply a high electrical field force to a cold cathode, i.e. a cathode that has not been specially heated. Such cold electron-emitting cathode surfaces are called field emission surfaces. In order to achieve field emission currents of any significance, it is necessary to apply very high electrical field forces to the cathode surface. In order to keep the voltage applied to the cathode to as low a level as possible, and at the same time to achieve high electrical field forces locally, the cathode surfaces are usefully provided with finely structured peaks.

The flat screens e.g. in present-day laptop computers or portable television sets normally function as LCD (liquid crystal display) screens. Such LCD screens, however, allow only low switching rates with fast moving pictures, and in general the quality of color reproduction does not match that required of conventional tube-type screens.

The technology offered by field emission screens (FED or field emission display) overcomes the disadvantages encountered with LCD screens.

FED screens usually comprise of a conventional, but not curved, phosphor-screen with a mask. A plate-shaped cathode is situated a distance e.g. 0.2 mm from it and features a matrix of fine, sharp peaks. These peaks may carry or be subjected group-wise to high voltage current, as a result of which electrons are emitted because of the field effect. The emitted electrons are then accelerated and so activate the facing illuminating material on the phosphor screen.

An image element of an FED screen is usefully comprised of three points which are provided with a red, green or blue light-emitting material. Directed at each of these points on the cathode side are about one thousand micro-peaks which together supply such a high yield of field-effect electrons that the FED screen exhibits much lower power consumption than conventional tube-type screens for the same brightness.

Compared with the LCD screen, the FED screen offers the advantage of inertia-free control of each image point. Also, image quality is independent of the angle of viewing.

A known method of manufacturing cold emitting cathode surfaces is to microstructure the cathode surface using photo-lithographic techniques that have been used for a long time now in the production of semiconductor elements. This method involves first using photolithographic techniques to create a photo-sensitive mask on the cathode surface having a field with a rectangular or circular opening. In a second step the substrate area not protected by the mask is etched such that, after dissolution of the photo-sensitive mask, pyramid or conical shaped emitter peaks are produced.

A further possibility for manufacturing field emission surfaces is isotropic etching of a crystalline material such as e.g. Si, producing fine peaks that are coated e.g. with an electron-emitting material. Also, semiconductor materials such as Si can be structured by photo-lithographic methods and e.g. subsequently coated with an electron emitting material.

The U.S. Pat. No. 4,591,717 describes a photoelectric detector based on a field emission surface having a light sensitive layer with a plurality of peaks of electrical conductive material. The peaks are produced by anodic oxidation of a substrate surface, in which process pores lying perpendicular to the substrate surface are formed and metal is precipitated into the said pores in such a manner that metal peaks that project beyond the oxide layer are formed.

The European patent EP 0 351 110 describes a process for manufacturing cold cathode emitter surfaces in which an aluminum oxide surface is provided with a plurality of longitudinal pores lying essentially perpendicular to the main surface of the aluminum oxide layer. The pores are filled with an electron emitting material then at least a part of this aluminum oxide layer is removed, as a result of which a surface with exposed electron emitting peaks is produced and the peaks face each other.

The state-of-the-art field emission surfaces, manufactured by forming an oxide layer containing pores, depositing electron emitting material on the surface layer and in the pore cavities, and subsequently removing the layer containing the pores, always exhibit at most as many electron-emitting peaks as the number of pores in the oxide layer contributing to their manufacture.

SUMMARY OF THE INVENTION

The object of the present invention is to provide a field emission surface that is cost favorable to produce and exhibits a higher number of electron emitting peaks per unit surface area than known, state-of-the art field emission surfaces.

That objective is achieved by way of the invention in that each peak-shaped element exhibits a cylindrical or blunted cone-shaped stem region and at least two, preferably 2 to 4 peaks at the free end of the stem region.

The substrate layer surface of the structured surface may be in the form of a flat or curved area e.g. a plane, a surface of an ellipsoid, in particular of a sphere, of a singular or double shell hyperboloid, of a paraboloid or of an elliptical, hyperbolic or parabolic cylinder.

Usefully, the part of the substrate layer between the peak-shaped elements is essentially flat, so that a well-defined surface structure is formed with peak-shaped elements clearly standing out of it.

In a preferred version the peak-shaped elements of the surface structured according to the invention are distributed uniformly over the substrate layer.

The peak-shaped elements of the structured surface preferably exhibit a stem region lying perpendicular to the substrate layer, at least in one area projecting out from the substrate layer. Especially preferred are peak-shaped elements the whole stem region of which lies perpendicular to the substrate layer surface. Very highly preferred are peak-shaped elements with stem region lying perpendicular to the substrate layer surface, the end peaks of which being designed such that their longitudinal axes form an acute angle, preferably an angle of 5 to 40° (referred to a circle of 360°) with the surface normals to the substrate layer.

In a preferred version the peak-shaped elements and/or the substrate layer are of Ni, Al, Pd, Pt, W, Fe, Ta, Rh, Cd, Cu, Au, Ag, In, Co, Sn, Si, Ge, Te, Se or a chemical compound containing at least one of these substances, such as e.g. Sn-oxide or InSn-oxide or an alloy of the above mentioned metals. The peak-shaped elements and the substrate layer are preferably of the same material.

Also preferred are surfaces structured according to the invention that are coated at least in part by one of the above mentioned materials.

In a further preferred version the substrate layer features between the peak-shaped elements a mechanical protective layer made of an electrically insulating material, preferably an oxide and in particular aluminum oxide. Usefully, the thickness of the mechanical protective layer is less than average height of the regions of origin of all peak-shaped elements measured over the whole of the structured surface.

Also preferred are structured surfaces with peak-shaped elements of essentially the same height, the height of a peak-shaped element being measured as the maximum vertical distance from the peak-shaped element to the surface of the substrate layer i.e. from the stem region and the end peak. Very highly preferred is for the height of the peak-shaped elements not to vary more than ±5% from the average height of all peak-shaped elements.

Further advantageous versions of the invention are described herein below.

BRIEF DESCRIPTION OF THE DRAWINGS

The present invention is more readily understood from a consideration of the following drawings, wherein.

DETAILED DESCRIPTION OF PREFERRED EMBODIMENTS

Figure 1:
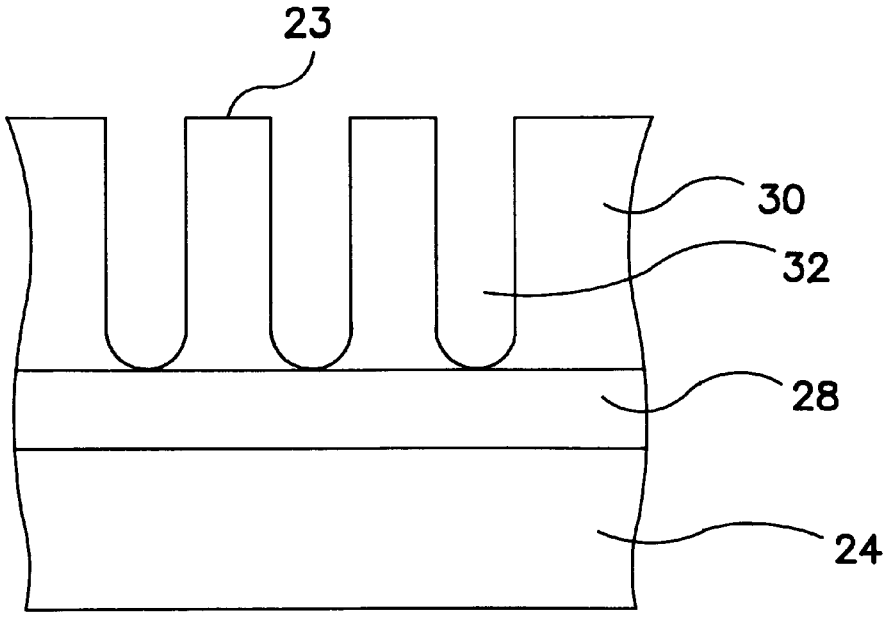
FIG. 1 is a schematic cross-section through a mold body not yet finished in its preparation.

The surfaces structured according to the invention are particularly well suited for use as field emission surfaces for cold cathode emitter elements, especially as cold cathode emission sources for ultra-flat screens, for electron lithography or for scanning or transmission microscopy. The peaks at the end of peak-shaped elements in such cases serve as emitter peaks. In order to achieve a well defined emitter structure, the part of the field emission surface lying between the peak-shaped elements is preferably essentially flat i.e. the part of the field emission surface lying between the peak-shaped elements does not contribute to field emission. As the number of emitter peaks required for field emission surfaces is large, field emission surfaces with curved substrate layers are also essentially flat in the region between the peak-shaped elements.

Also preferred is for the peak-shaped elements in the structured surface to be such that on applying to the end peaks an operating voltage of less than 2000 V, usefully less than 1800 V, preferably less than 900 V, and in particular less than 100 V, an electric field force of more than $10^9$ V/m is produced. The operating voltage means the voltage applied from an external power source to the structured surface, e.g. its substrate layer.

The objective with respect to the process is solved by way of the invention in that:

a) in a first step a mold body (22) with a surface (23) that is a mirror-image of the desired structured surface is created, whereby a substrate (24) of aluminum is oxidised anodically in an electrolyte that dissolves aluminum oxide, whereby the anodizing voltage in a first anodizing step is increased continuously or in steps from 0 to a first value $U_1$, and in a second anodizing step the anodizing voltage is reduced continuously or in steps to a second value $U_2$ that is smaller than $U_1$.

b) in a second step the surface (23) of the mold body (22) is coated over the whole surface area such that the pore cavities (36) present in the surface layer (23) of the mold body (22) are completely filled with the coating material and, a support layer (12) is formed connecting the peak-shaped elements (14) electrically, and the support layer (12) represents a continuous, mechanically supporting layer;

c) and in a third step at least a part of the mold body (22) is removed such that the end peaks (20) are exposed.

The mold body required to form the structured surface and having a surface that is essentially a mirror-image of the desired structured surface is comprised usefully of a substrate and a forming layer, which contains the surface structure which is the mirror-image of the desired surface.

The substrate is preferably in the form of a part, e.g. a section, beam or another form of parts, a plate, coil, sheet or a foil of aluminum, or an aluminum outer layer of a composite material, especially as an aluminum outer layer on a laminate panel, or concerns an aluminum layer deposited, e.g. electrolytically, on any other material, such as e.g. a clad aluminum layer. Also preferred is for the substrate to be a piece made of aluminum, which has been manufactured e.g. by a rolling, extrusion, forging or pressing process. the substrate may also be shaped by bending, deep-drawing, cold impact extrusion or like process.

The term aluminum in the present text includes all grades of purity and all commercially available aluminum alloys. For example the term aluminum includes all rolling, wrought, casting, forging and extrusion alloys of aluminum. Usefully, the substrate comprises pure aluminum with a purity of 98.3 wt. % Al or higher or aluminum alloys containing at least one of the following elements viz., Si, Mg, Mn, Cu, Zn or Fe. The substrate of pure aluminum may e.g. be of aluminum with a purity of 98.3 wt. % and higher, usefully 99.0 wt. % and higher, preferably 99,9 wt. % and higher and in particular 99.95 wt. % and higher, the rest being impurities commonly occurring in aluminum.

Apart from aluminum of the above mentioned purities the substrate may also be of an aluminum alloy containing 0.25 wt. % to 5 wt. % magnesium, especially 0.5 to 2 wt. % magnesium, or contain 0.2 to 2 wt. % manganese or contain 0,5 to 5 wt. % magnesium and 0.2 to 2 wt. % manganese, especially e.g. 1 wt % magnesium and 0.5 wt. % manganese or contain 0.1 to 12 wt. % copper, preferably 0.1 to 5 wt. % copper or contain 0.5 to 5 wt. % zinc and 0.5 to 5 wt. % magnesium or contain 0.5 to 5 wt % zinc, 0.5 to 5 wt. % magnesium and 0.5 to 5 wt. % copper or contain 0.5 to 5 wt. % iron and 0.2 to 2 wt. % manganese, especially e.g. 1.5 wt. % and 0.4 wt. % manganese.

The mold layer is preferably of aluminum oxide. A mold layer necessary for the process according to the invention is preferably produced by anodic oxidation of the substrate surface in an electrolyte under conditions that cause pores to be created. Essential to the invention in that respect is that the pores are open towards the free surface. Usefully, the distribution of pores over the surface is uniform. The thickness of the mold layer is usefully 50 nm to 20 $\mu$m and preferably 0.5 to 3 $\mu$m.

In the vertical direction, towards the surface of the mold layer, the pores exhibit a stem region and, towards the substrate, a branching region i.e. each pore, essentially running vertical to the surface of the mold layer, comprises a longitudinal pore which is open towards the free surface of the mold layer and which divides itself in the branching region into at least two, preferably 2 to 4 recesses or pore branches. Usefully the pores exhibit a diameter of 1 to 250 nm, preferably 10 to 230 nm and in particular 80 to 230 nm in their stem region. The number of pores, i.e. the number of pores in the stem region is usefully $10^8$ pores/cm$^2$ and higher, preferably $10^8$ to $10^{12}$ pores/cm$^2$ and in particular $10^9$ to $10^{11}$ pores/cm$^2$. The average density of the mold layer is preferably 2.1 to 2.7 g/cm$^3$. Also preferred is for the mold layer to exhibit a dielectric constant of 5 to 7.5.

The mold layer is produced e.g. by anodic oxidation of the substrate surface in an electrolyte that redissolves the aluminum oxide. The temperature of the electrolyte is usefully between−5 and 85° C., preferably between 15 an 80° C., and especially between 15 and 55° C. In order to carry out the anodic oxidation, the substrate, or at least its surface layer, or at least the part of the substrate surface that is to be provided with a mold layer, is placed in an appropriate electrolyte and connected up as the positive electrode (anode). Another electrode e.g. of stainless steel, lead, aluminum or graphite in the same electrolyte serves as the negative electrode (cathode).

Normally the surface of the substrate is subjected to a pre-treatment prior to the process according to the invention, in which pre-treatment the substrate surface is e.g. degreased, then rinsed and finally subjected to caustic pickling. The pickling is carried out e.g. using a sodium hydroxide solution at a concentration of 50 to 200 g/l at 40 to 60° C. for one to ten minutes. Following that, the surface may be rinsed and neutralized using an acid such as e.g. nitric acid, especially at a concentration of 25 to 35 wt. % at room temperature, i.e. typically in the temperature range 20–25° C. for 20 to 60 sec. and the rinsed again.

The properties of an oxide layer produced by anodizing e.g. the pore density and pore diameter depend substantially on the anodizing conditions such as e.g. electrolyte composition, electrolyte temperature, current density, anodizing voltage, duration of anodizing and on the material being anodized. While anodizing in acidic electrolytes an essentially pore-free base or barrier layer is formed on the surface of the substrate and, on top of that, a porous outer layer which is partially, chemically redissolved at its free surface during the anodizing process. As a result, pores are formed in the outer layer; these are essentially vertical to the surface of the substrate body and are open at the end meeting the free surface of the oxide layer. The oxide layer reaches its maximum thickness when its growth and dissolution balance each other, which depends e.g. on the applied anodizing voltage, the composition of the electrolyte, the current density, the temperature of the electrolyte, duration of anodizing and on the material being anodized.

Electrolytes that are preferred for the process according to the invention are those containing one or more inorganic and/or organic acids. Also preferred are anodizing voltages of 10 to 100 V and current densities of 100 to 3000 A/m$^2$. The duration of anodizing is typically 1 to 300 sec.

The surface of the substrate is preferably anodized such that the anodizing voltage for forming cylindrical or blunted cone-shaped, long pores is set at a first value ($U_1$), preferably lying between 12 and 80 V and subsequently, in order to form at least two pore branches at the end of each long pore facing the aluminum layer, set at a second value ($U_2$), the second value being lower than the first value and preferably lying between 10 and 20 V.

The anodizing voltage is applied e.g. by continuously raising the applied voltage until the predetermined, constant value is reached. The current density increases accordingly as a function of the applied anodizing voltage and, after reaching the predetermined constant voltage, arrives at a maximum value then drops to a lower value.

The thickness of the barrier layer depends on the voltage applied and lies e.g. in the range 8 to 16 Angström/V, in particular between 10 and 14 Angström/V. The diameter of the pores in the outer layer is likewise dependent on the voltage and lies e.g. in the range of 8 to 13 Angström/V, in particular 10 to 12 Angström/V.

The electrolyte may e.g. be a strong organic and/or inorganic acid or contain a mixture of strong organic and/or inorganic acids. Typical examples of such acids are sulphuric acid ($H_2SO_4$), or phosphoric acid ($H_3PO_4$). Other acids which may be employed are e.g. chromic acid, oxalic acid, sulphaminic acid, malonic acid, maleic acid or sulphosalacylic acid. Also, mixtures of the above mentioned acids may be employed. Used for the process according to the invention is e.g. sulphuric acid in concentrations of 40 to 350 g/l, preferably 150 to 200 g/l (sulphuric acid referred to 100% acid). Also useable as electrolyte is phosphoric acid in concentrations of 60 to 300 g/l, in particular 80 to 150 g/l, the amount of phosphoric acid referring to 100% pure acid. Another preferred electrolyte is sulphuric acid mixed with oxalic acid, in particular concentrations of 150 to 200 g/l sulphuric acid together with e.g. 5 to 25 g/l oxalic acid. Also preferred are electrolytes containing e.g. 250 to 300 maleic acid and e.g. 1 to 10 g/l sulphuric acid. A further electrolyte contains e.g. 130 to 170 g/l sulphosalacylic acid mixed with 6 to 10 g/l sulphuric acid.

After anodizing, the surface of the mold layer may be subjected to further treatments such as e.g. chemical or electrolytic etching, plasma etching, rinsing or impregnating.

The finished mold layer is then coated over its whole surface area in such a manner that the pore cavities in the surface layer are completely filled with coating material and a support layer, that connects the peak-shaped elements electrically, is formed; the support layer takes the form of an interconnected mechanically-supportive layer.

Materials used for coating the surface of the mold body are preferably Ni, Al, Pd, Pt, W, Fe, Ta, Rh, Cd, Cu, Au, Ag, In, Co, Sn, Si, Ge, Se, Te, or a chemical compound containing at least one of these elements, or an alloy of the above mentioned metals.

The surface of the mold body may be coated e.g. by chemical or electrolytic methods or by PVD (physical vapor deposition) or CVD (chemical vapor deposition). Chemical and/or electrolytic deposition of the coating material is preferred, whereby the pore cavities are usefully chemically activated in advance.

In the last step essential to the process according to the invention the peak-shaped elements, in particular the peaks at the ends, are exposed by complete or partial removal of the mold layer.

Complete exposure of the peak-shaped elements i.e. separation of the structured surface layer from the body, may take place e.g. by etching away the body part completely. In a preferred version, however, only the mold layer is etched away chemically, with the result that the structured surface is separated completely from the body and is obtained in the form of a structured surface.

In a second preferred version only a part of the mold layer is etched away, with the result that the mold layer remains on the support layer between the stems of the peak-shaped elements forming a mechanical support layer. This is achieved e.g. by chemically etching away the substrate body, the barrier layer and a part of the porous layer. The porous part of the mold layer must, however, be removed in such a manner that the end peaks of the peak-shaped elements are completely exposed.

In a further preferred version of the process according to the invention the exposed peak-shaped elements are subjected to a further etching process e.g. plasma etching or wet chemical or electrolytic etching. This way it is possible e.g. to optimize the shape of the end peaks with respect to their application as electron emission peaks.

Also preferred is an after-treatment of the surface structured according to the invention viz., deposition of an additional, thin metal layer that improves the electron emitting properties of the peak-shaped elements. This additional, thin metal layer is preferably of a noble metal, especially Au, Pt, Rh or Pd, or an alloy containing at least one of these noble metals. This additional metal layer may be deposited e.g. by chemical or electrochemical methods, by PVD (Physical Vapor Deposition) such as e.g. by sputtering or electron-beam vapor deposition, or by CVD (Chemical Vapor Deposition).

Described in the following are examples illustrating the production of the surface structured according to the invention. All details referring to parts or percentages refer to weight unless otherwise indicated.

FIRST EXAMPLE

The substrate body in the form of an aluminum sheet of 99.9 wt. % Al exhibits a bright, shiny surface. The aluminum sheet is cleaned in a mild alkaline degreasing solution, rinsed in water, pickled in nitric acid, rinsed in water, immersed briefly in acetone and dried.

Following this a suitable covering layer is deposited on the back of the sheet and the pretreated substrate body anodized for 3 min. using direct current in a phosphoric acid electrolyte having a concentration of 150 g/l $H_3PO_4$ at a temperature of 35° C.; the current density is 100 A/m$^2$, the anodizing voltage being raised continuously from 0 to 50 V. Directly after this the anodizing voltage is reduced in 5 to 6 steps to about 15 V, the voltage reductions initially being small then gradually greater. On reaching the anodizing potential of about 15 V, this is maintained for an interval of 40 sec. The resultant layer of aluminum oxide is typically 1 $\mu$m.

The mold layer exhibits pores which project out towards the free surface of the aluminum oxide layer, a stem region that is open at the top and exhibits a branched region facing the substrate body.

The mold body i.e. in particular the free surface of the mold layer is then rinsed with water, treated under an applied alternating voltage of 16 V for 5 sec. in an activation bath containing nickel salts (100 g/l $NiSO_4.7H_2O$ and 40 g/l boric acid, pH 4.0 to 5.0) then rinsed again with water.

The pores in the pre-treated mold layer exhibit at the base of the pores nickel particles which gather there and can serve preferably as nuclei for further selective deposition of nickel. The selective deposition of nickel i.e. the further deposition of nickel on the nickel particles already in the pores is carried out initially chemically in a nickel bath, at a temperature of 85° C. and a pH value of 5.0, containing a sodium hypophosphite solution as reduction agent. The selective deposition of nickel lasts 1 hour, during which a layer of nickel-phosphorus containing 10 to 12 wt. % phosphorus and a layer approximately 10 $\mu$m thick is obtained. The mold layer with a deposit of nickel on it is then rinsed again with water; following that, the nickel layer is thickened in a commercially available electroplating nickel bath ("Watt" bath, containing e.g. 300 g/l nickel sulphate, 60 g/l nickel chloride, 40 g/l boric acid and organic additives such as wetting agents) for 20 minutes at a current density of 400 A/m$^2$ measured at the cathode. The temperature of the electrolyte during that time is 50 to 60° C.; the nickel layer produced by electroplating reaches a thickness of about 16 $\mu$m.

After rinsing the nickel-coated mold body again with water, the covering layer on the back is removed e.g. chemically or by plasma etching. The mold body is then dissolved chemically in caustic soda solution (50 g/l NaOH). When the NaOH bath is at 20° C., this process lasts several hours, e.g. 1 to 5 hours.

After removing the body part, the desired structured nickel film with peak-shaped elements remains, said elements exhibiting a stem region attached to the Ni support layer and, as vertical continuation of the stem, a branching region featuring at least two peaks at the end.

The structured Ni film is again rinsed with water, pickled in 5% citric acid at 20° C. for 30 min., again rinsed with water, placed in ethanol and finally dried.

The peak-shaped elements represent an exact image of the pore cavities in the aluminum oxide layer as the aluminum oxide layer acts as a mask for the deposition of the nickel. The structured Ni film features many closely spaced peaks approximately 1 $\mu$m long and typically less than 0.2 $\mu$m in diameter.

SECOND EXAMPLE

An aluminum sheet, such as described in the first example, and serving as the substrate, is cleaned and anodized as described in the first example. The mold surface layer is then activated as in the first example.

Selective deposition of nickel then takes place in a chemical nickel bath at a temperature of 70° C. and a pH value of 6.0; the reduction agent in the nickel bath is dimethyl-amine-borane. The selective deposition of nickel last for about 1 hour, during which an approximately 5 $\mu$m thick nickel-boron layer containing less than 1% boron is formed. As in the first example, because of the special method of activation, the nickel layer starts forming first only at the bottom of the pores.

After rinsing with water, the cover layer is removed as in the first example, the mold body dissolved and the structured nickel film exposed.

The peak-shaped elements of the structured nickel film are now subjected to an electrolytic after-treatment in which the radius of curvature of the end peaks is made smaller so that a field emission surface with better electron emitting properties is produced. The electrolyte employed for that purpose contains 638 ml/l of 96% sulphuric acid and 9 g/l of glycerine.

The electrolytic after-treatment lasts for 5 to 10 sec. at an electrolyte temperature of 20° C. using a lead cathode, a current density of 500 to 1000 A/m$^2$ and an electrolizing voltage of 6 V. After this the structured nickel film is rinsed again with water and dried.

THIRD EXAMPLE

A structured nickel film produced as in one of the first two examples is subsequently gold plated in a conventional gold plating bath for 60 sec., in which process the gold bath has a gold concentration of 2 g/l, the bath temperature is 85° C. and has a pH value of 4.4 to 4.8. An approx. 0.05 $\mu$m thick gold layer is formed as a result of this electroplating process. The gold plated nickel film is subsequently rinsed with water, treated with ethanol and dried.

Such a treatment of the nickel film markedly improves its properties as a field emission surface.

The present invention is explained further by way of examples in FIGS. 1 to 4.

FIG. 1 shows schematically a cross-section through a mold body 22 that is not yet finished in its preparation, exhibiting pores that run vertical to the surface 23 of the mold body, are open at the top and feature a longitudinal cavity 32 without branching i.e. the stem region 32 of the pores. The mold body in FIG. 1 already comprises a substrate 24 and the mold layer 26, which comprises in turn of a barrier layer 28 and a porous layer 30.

A body as shown in FIG. 1 is formed e.g. by anodic oxidation of a substrate 24 of aluminum, under constant or continuously or stepwise increasing anodizing voltage, in electrolyte that redissolves the aluminum oxide.

Figure 2:
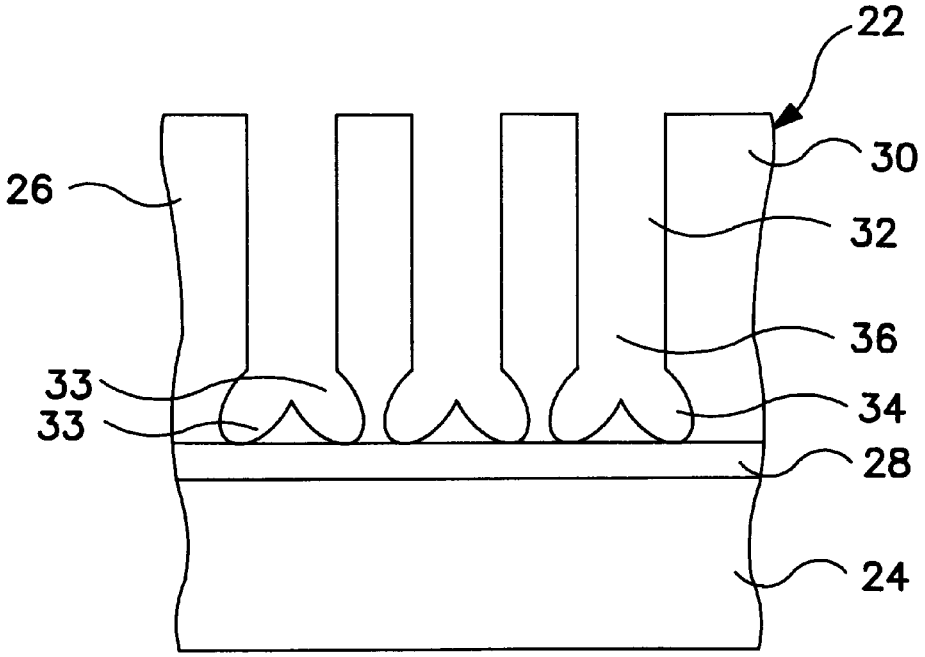
FIG. 2 is a schematic view similar to FIG. 1.

FIG. 2 shows schematically a cross-section through a mold body 22 which may be employed for the process according to the invention. The mold body 22 is made up of the substrate 24 and the mold layer 26. The cavity 36 of the pores comprises a pore stem region 32 and a pore branching region 33, each pore cavity 36 exhibiting two pore branches 34 in the branching region 33.

A mold body 22 as in FIG. 2 is formed e.g., starting from a mold body 22 that is not yet finished in its preparation, as shown in FIG. 1, by continuing the anodizing process further at a lower anodizing voltage. To that end the anodizing voltage may be reduced in steps or continuously. The diameter of the pores formed during anodizing and the thickness of the barrier layer 28 depend on the magnitude of the anodizing voltage. The thickness of the barrier layer 28, therefore becomes less during such a second stage in the process, whereas the thickness of the porous oxide layer 30 increases further. As the formation of the oxide layer 28, 30 takes place at the interface between the aluminum substrate 24 and the barrier layer 28, and while the pore diameter depends on the anodizing voltage, a plurality of branches 34 of smaller diameter than the stem region is formed at the end of the stem region 32.

Figure 3:
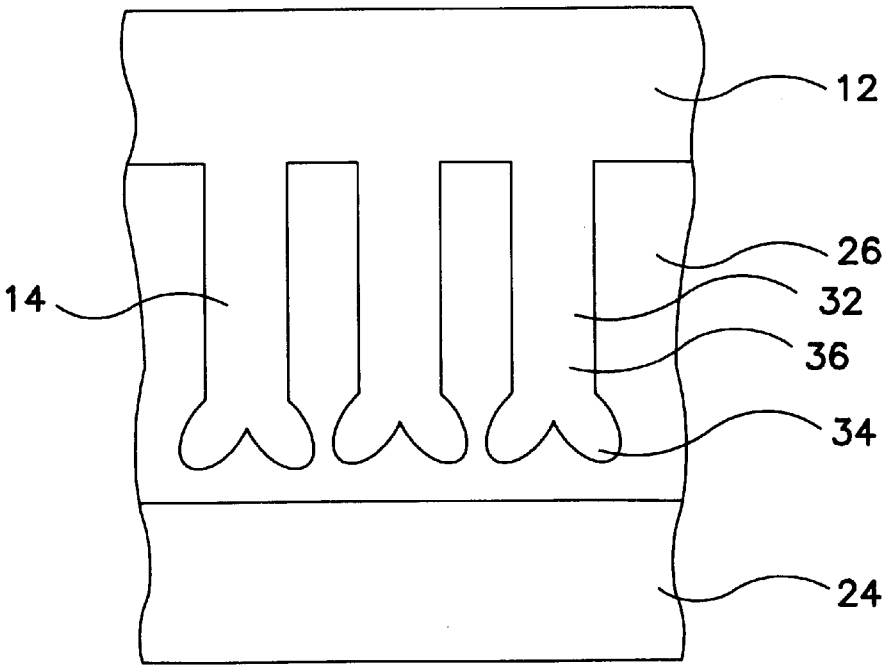
FIG. 3 is a schematic view similar to FIG. 1 of a mold body coated with electron emitting material.

FIG. 3 shows schematically the cross-section through a mold body 22 coated with electron emitting material. The mold body 22 comprises a substrate 24 and a mold layer 26. The layer 26 contains pores, the cavities 36 of which exhibit a stem region 32 and a branching region 33 with at least two pore branches 34. The cavity 36 is completely filled with electron emitting material and the peak-shaped elements 14 of electron emitting material thus formed are connected electrically by way of a support layer 12.

A mold body 22 as shown in FIG. 3, coated with electron emitting material is formed when, starting from a mold body 22 as shown in FIG. 2, the surface 23 of the mold body is chemically activated, at least in the pores, the pore cavities 36 coated with electron emitting material either by means of chemical and/or electrochemical processes, and an electron emitting layer 12 e.g. of metal or semiconducting metal is deposited on the resultant peak-shaped elements 14 and on the surface 23 between the pore cavities 36.

Figure 4:
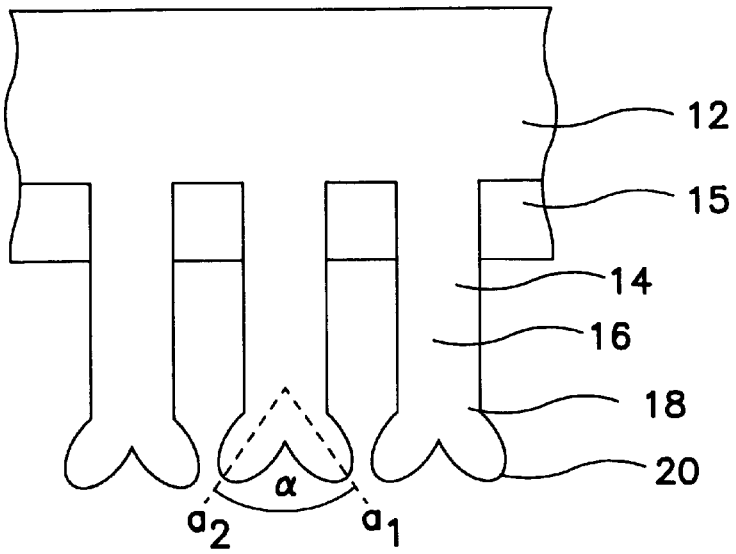
FIG. 4 is a schematic view through a surface structured according to the invention.

FIG. 4 shows schematically the cross-section through a surface structured according to the invention. This comprises a support layer 12 electrically connecting peak-shaped elements made e.g. of metal or semi-conducting metal i.e. of electron emitting material. The peak-shaped elements exhibit a stem region 16 and a branching region 18, the peak-shaped elements 14 exhibiting in the branching region 18 two end peaks 20, the longitudinal axes $a_1$, $a_2$, of which enclose an acute angle $\alpha$. The stem region 16 of the peak-shaped elements 14 are supported mechanically by a support layer 15 between them, whereby a part of the stem region 16 and the end peaks 20 are exposed.

A structured surface as shown in FIG. 4 is formed when, starting from a mold body 22 coated with electron emitting material, as is shown in FIG. 3, the substrate 24 and a part of the mold layer 26 are chemically etched away.

We claim:

1. Process for manufacturing structured surfaces having a support layer and peak-shaped elements connected electrically to said support layer, which comprises:

a) in a first step a mold body with a surface that is a mirror-image of the desired structured surface is created, whereby a substrate of aluminum is oxidized anodically in an electrolyte that dissolves aluminum oxide, whereby the anodizing voltage in a first anodizing step is increased continuously or in steps from 0 to a first value $U_1$, and in a second anodizing step the anodizing voltage is reduced continuously or in steps to a second value $U_2$ that is smaller than $U_1$;

b) in a second step the surface of the mold body is coated over the whole surface area such that the pore cavities present in the surface layer of the mold body are completely filled with the coating material and, a support layer is formed connecting the peak-shaped elements electrically, and that the support layer represents a continuous, mechanically supporting layer;

c) and in a third step at least a part of the mold body is removed such that the peaks are exposed.

2. Process according to claim 1, wherein the first value $U_1$ of the anodizing voltage for forming cylindrical, or blunted cone-shaped, long pores lies between 12 and 80 V and, in order to form at least two pore branches at the end of each long pore facing the aluminum layer, the second value $U_2$ lies between 10 and 20 V.

3. Process according to claim 1, wherein the materials used for coating the mold body surface are selected from the group consisting of Ni, Al, Pd, Pt, W, Fe, Ta, Rh, Cd, Cu, Au, Ag, In, Co, Sn, Si, Ge, Se, Te, a chemical compound containing at least one of these elements, and an alloy of the above mentioned metals.

4. Process according to claim 1, wherein the coating on the mold body surface is performed by at least one of chemical and electrolytic methods.

5. Process according to claim 1, wherein the removal of at least part of the mold body is performed by etching away chemically the substrate body and at least a part of the mold layer.

6. Process according to claim 1, wherein the peak-shaped elements, which are at least partially exposed, are subjected to one of a chemical and electrolytic etching process.

* * * * *